United States Patent [19]

Riggs

[11] 4,147,126

[45] Apr. 3, 1979

[54] COATING APPARATUS

[75] Inventor: Aubrey F. Riggs, Knebworth, England

[73] Assignee: Imperial Chemical Industries Limited, London, England

[21] Appl. No.: 750,020

[22] Filed: Dec. 13, 1976

[30] Foreign Application Priority Data

Jan. 15, 1976 [GB] United Kingdom ..... 1613/76
Dec. 1, 1976 [GB] United Kingdom ..... 50092/76

[51] Int. Cl.[2] ..... B05C 1/08
[52] U.S. Cl. ..... 118/227; 118/241
[58] Field of Search ..... 118/217, 246, 247, 226–228, 118/241, 6, 212, 249, 250; 427/428, 211; 101/350, 153, 247, 220, 154

[56] References Cited

U.S. PATENT DOCUMENTS

| | | | |
|---|---|---|---|
| 751,946 | 2/1904 | Schoening | 101/247 X |
| 1,345,719 | 7/1920 | Vavra | 118/227 X |
| 2,300,078 | 10/1942 | Von Hofe | 118/241 X |
| 2,393,529 | 1/1946 | Harrigan | 118/DIG. 15 |
| 2,723,918 | 11/1955 | Nichols | 118/241 X |
| 2,852,407 | 9/1958 | Wood, Jr. et al. | 118/241 X |
| 3,285,169 | 11/1966 | Hartwig | 101/350 X |
| 3,443,516 | 5/1969 | Schnall | 101/218 |
| 3,552,353 | 1/1971 | Labombarde | 118/249 X |
| 3,585,932 | 6/1971 | Granger | 101/350 |
| 3,647,525 | 3/1972 | Dahlgren | 427/428 |

FOREIGN PATENT DOCUMENTS

| | | | |
|---|---|---|---|
| 1510917 | 12/1967 | France | 118/227 |
| 644789 | 10/1950 | United Kingdom. | |

*Primary Examiner*—Morris Kaplan
*Attorney, Agent, or Firm*—Cushman, Darby & Cushman

[57] ABSTRACT

Method and apparatus for simultaneously coating both surfaces of a moving web by a direct-indirect gravure technique in which the transfer roll of the indirect gravure system acts as backing roll for the direct gravure roll. The transfer roll is displaceable from the coating position to an inoperative position in contact with the indirect gravure roll to ensure that coating liquid does not form a dry layer on the surface of the transfer roll when the coating operation is interrupted and to remove the web from contact with either coating roll.

6 Claims, 4 Drawing Figures

COATING APPARATUS

Figure 1:
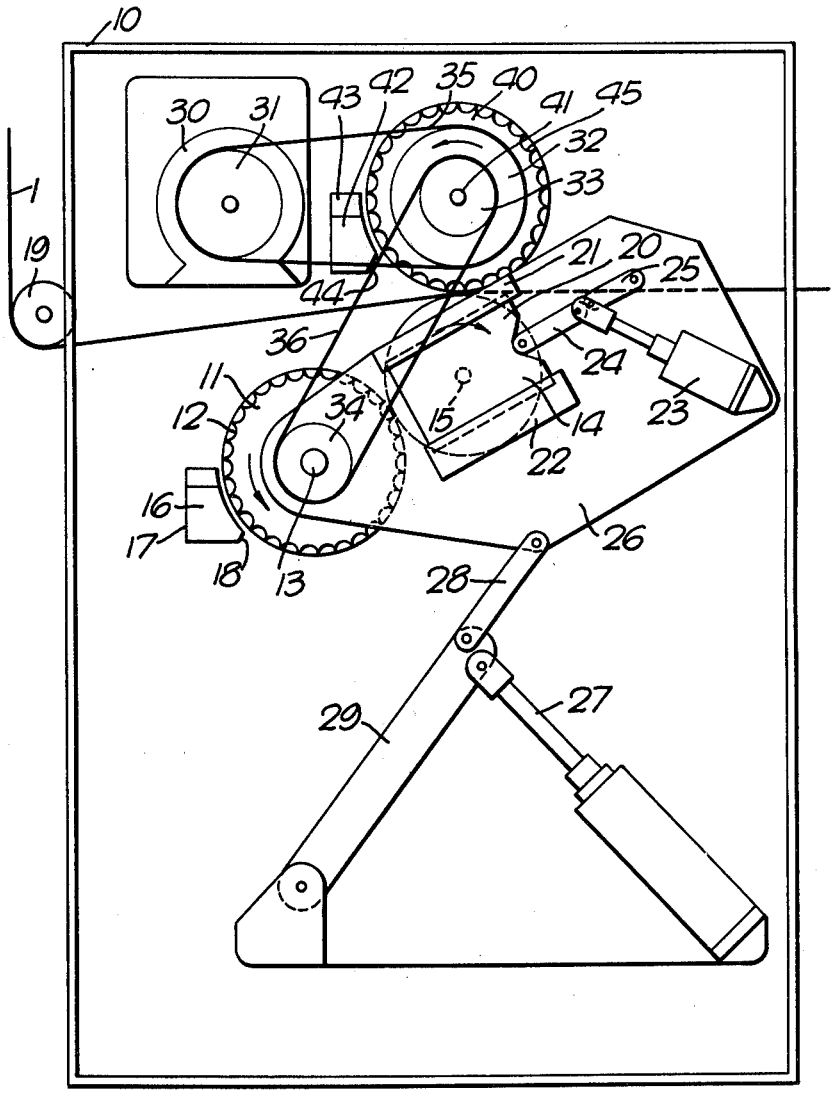

This invention relates to coated webs, and, in particular, to apparatus for simultaneously applying a gravure coating to each surface of a web.

A web is considered to be any material in laminar form capable of being fed from a roll or other source of supply, subjected to a processing treatment, and subsequently rewound in roll-form, or cut into sheets or otherwise converted for use by a consumer. Typical webs include paper, and plastic films.

The term "coating" is used throughout this specification to describe both the process of depositing a liquid or flowable material, including printing inks, in a controlled manner on to a surface of a moving web, and the layer of material so deposited on that surface either in the wet state or in a subsequently dried condition.

Coating of a web is commonly achieved by means of a gravure coater which utilizes a rotating roll having on the surface thereof a knurled or engraved pattern of depressions or cells which pick up coating material from an appropriately positioned receptacle, and deposit the coating material on a surface of a web moving in contact with the surface of the gravure roll. To assist spreading of the coating material, and improve the uniformity of the layer deposited on the web surface, the coating material picked up on the cellular surface of the gravure roll may first be transferred to the resilient surface of a cooperating transfer roll, and thence to the surface of the web, this technique being commonly described as indirect, or off-set, gravure coating.

Conventional gravure techniques are limited to the application of a coating to one surface of a web, the coated web subsequently being passed through an oven to dry the applied coating. Because of the relatively high web speeds employed the drying ovens are usually large and complex structures. If a coating is to be applied to each surface of a moving web, these coatings must be applied sequentially, the first applied coating being dried prior to the application of the second coating, to avoid disruption of the first coating during the webhandling operations involved in the application of the second coating. Sequential coating, therefore, requires two spaced-apart coating stations, and either two large drying ovens, or, alternatively, a complex webhandling system enabling the coated web to make two passes through a single drying oven. Sequential coating operations are therefore extravagant in terms both of costly equipment, and of the space required for the installation of that equipment. Furthermore, there is always a risk that, despite all precautions, the first applied coating will be disrupted during the handling operations required to apply the second coating.

We have now devised a simultaneous gravure coating system in which these drawbacks are reduced or eliminated.

Accordingly, the present invention provides apparatus for simultaneously applying a coating to each surface of a moving web comprising a first, fixedly positioned, rotatable gravure roll, a transfer roll rotatable in an operative position in a simultaneous contact with the surface of the first gravure roll and with a first surface of the moving web, a second gravure roll rotatable in contact with a second surface of the moving web and cooperating with the transfer roll to provide a nip through which the web may be passed, and mounting means for the transfer roll, said mounting means being operable to displace the transfer roll, relative to said fixedly positioned gravure roll, to an inoperative position in which the transfer roll is disengaged from the web surface but is rotatable in contact with the surface of the first gravure roll.

Disclosed is also a method of simultaneously applying a coating to each surface of a moving web comprising supplying a coating material to the surface of a first rotating gravure roll, transferring said coating material to the surface of a transfer roll rotating in contact with the surface of the first gravure roll, supplying a coating material to the surface of a second gravure roll rotating in cooperation with the transfer roll to define a nip, and feeding the web through the nip, thereby depositing a layer of coating material on each surface of the web, said transfer roll being displaceably mounted for disengagement from the web surface to a position in which the transfer roll is rotatable in contact with the surface of the first gravure roll.

The application of a coating of uniform thickness depends to a significant extent on the correct positioning and alignment of the gravure rolls relative to the web, and once this position has been established it is undesirable to displace these rolls unnecessarily because, in practice, it is usually impossible to replace the rolls precisely in the original position. The first gravure roll is therefore described as "fixedly positioned" in that during the coating operation that roll will not normally be displaced from the established position other than by the relatively minor adjustments of the supporting bearings required to maintain uniformity of coating by compensating from the usual fluctuation of operating parameters encountered in normal operation of the equipment. The gravure roll can, of course, be removed from its bearings — for example, when replacement or refurbishing of the roll is required. Desirably, the second gravure roll is also fixedly positioned.

The transfer roll is supported in an operative position, in which it contacts the surfaces of both the web and first gravure roll, by mounting means operable to disengage the transfer roll from contact with the web surface to an inoperative position in which the transfer roll is rotatable in contact with the surface of the first gravure roll. Disengagement in this manner ensures that coating material is supplied to the surface of the transfer roll in the inoperative position but is not thence transferred to the web surface, that a dry crust of coating material does not accumulate on the surface of the inoperative transfer roll, and that web coating of an acceptable standard is achieved on return of the transfer roll to the operative position.

To disengage the transfer roll from an operative position to an inoperative position, any suitable mounting, for example retractable locating members, may be employed to support the transfer roll. However, to ensure that the coating material on the surface of the transer roll is prevented from drying out, we prefer that the transfer roll is maintained continuously in rotatable contact with the first gravure roll throughout the transition from the operative to the inoperative position. This is conveniently achieved by mounting the transfer roll in a pair of axially spaced-apart support members, one at each end of the transfer roll, mounted for pivotal movement about the rotational axis of the first gravure roll. Simultaneous pivotal movement of the support members may be effected by conventional actuating means — suitably by a fluid-actuated system, such as a hydraulic or pneumatic system.

To facilitate cleaning of the surface of the transfer roll, the latter is preferably mounted so that in the inoperative position it may be disengaged from the surface of the first gravure roll. A slide mounting for the transfer roll, on each of the aforementioned pivotal supports members, slidable radially outward relative to the rotational axis of the first gravure roll, provides a simple and effective mechanism for achieving this disengagement.

In practice, each gravure roll is driven at an appropriate peripheral speed to match the linear speed of the web being coated, and, preferably, the two gravure rolls are coupled together for example, by an endless belt-pulley system, to ensure identical rotational speeds. Although the transfer roll may idle in the operative position, being rotated by frictional contact with both the moving web and the first gravure roll, we prefer that the transfer roll is also positively driven at an appropriate peripheral speed. Preferably, the transfer roll is driven independently of the gravure rolls, thereby enabling the peripheral speed of the transfer roll to be synchronised with the linear speed of the moving web.

A pulley-mounted, endless belt system coupled to a prime mover, such as an electrical motor, provides a convenient variable-speed drive means for the transfer roll without requiring a complex gearing system. A pulley, or the like, slidably mounted on the pivot support member to maintain an appropriate tension in the endless belt enables the transfer roll to be continuously driven in the inoperative position by the endless belt, even when the transfer roll is slidably disengaged from the gravure roll, thereby facilitating access to all parts of the transfer roll surface — particularly to facilitate inspection and cleaning thereof.

The surface of each gravure roll is provided with a pattern of cells or depressions by conventional techniques, such as engraving or etching, an appropriate pattern being selected to achieve an acceptable standard of coating with the coating material to be employed. Thus, cells having a triangular, quadrangular, or helicoidal, configuration may be employed. However, for the application of a primer coating to a thermoplastic polymeric film, cells of approximately hemispherical configuration have been found to be particularly appropriate. Suitable hemispherical cells have a diameter, at the roll surface, in a range of from about 75 to 125 microns, preferably about 100 microns, and a depth of from 25 to 50 microns, preferably about 35 microns. The cells conveniently occupy the roll surface at a line spacing of from about 100 to 200 per inch, i.e. at a density of from about 10,000 to 40,000 per square inch (1,500 to 6,200 per $cm^2$).

The transfer roll is suitably of, or provided with a surface layer of, a resilient material, such as rubber or a synthetic polymeric material. The hardness of the transfer roll surface is selected so as to provide acceptable deposition and spreading of the coating material on the moving web, and is suitably within a range of from 65 to 85, preferably about 75, units of Shore hardness. The Shore hardness, or schleroscope, test provides an indication of the hardness of a surface by measuring the height of rebound of a diamond-tipped conical hammer falling under gravity onto that surface. By way of example, a high-carbon steel normally exhibits a Shore hardness of the order of 100.

Coating material may be supplied to the surface of the gravure rolls by conventional techniques - for example, from a drip-feed, or by partial immersion of the indirect gravure roll in a bath of the coating material, excess of the coating material being removed from the gravure roll by an air-knife, doctor blade, or like mechanism. A particularly suitable means for supplying a coating liquid of relatively high viscosity to a gravure roll comprises a container for the coating liquid having a retaining partly provided partlyprovided by the surface of the gravure roll itself, and a doctor blade contacting the roll in the region of the bottom of the container, the doctor blade being downwardly inclined away from the roll surface. A container of this kind is disclosed in British Patent No. 1,255,594. The doctor blade is preferably fabricated from a sheet of 'Melinex' brand polyethylene terephthalate, 'Melinex' being a registered Trade Mark of Imperial Chemical Industries Limited.

Although the system of the present invention can be operated so that the path of the web through the nip between the transfer roll and second gravure roll follows a selected direction, including substantially vertical, we prefer, particularly to facilitate installation and operation of the drying oven(s) through which the freshly coated web is normally passed, to arrange the coating system so that the path of the web through the nip is in a substantially horizontal direction. Effectively, therefore, the web travels in substantially tangential contact with the surface of the transfer roll and with that of the second gravure roll, there being substantially no wrap-around of the web on the surface of either of these rolls.

Although, in general, contact with the freshly deposited coatings on the web surfaces should be avoided until the coatings have dried, additional spreading and smoothing of one or both coatings may, if desired, be effected by conventional methods — for example by contacting the coated surface(s) with one or more bars or rolls prior to passage of the coated web through the drying oven(s).

In a preferred embodiment of the invention, control means are provided to maintain the tension in the web at substantially identical values both before and after passage of the web through the gravure coating assembly. By controlling tension in this way, longitudinal stretching of the web is avoided, and slippage of the web on the coating rollers is prevented. Furthermore, only a comparatively small pressure need be maintained in the nip between the transfer roll and second gravure roll, thereby reducing damage both to the web and to the surfaces of the nip coating rolls. Tension control is conveniently effected by means of a pair of conventional dancer roll assemblies appropriately positioned respectively on the web inlet and exit paths, each dancer roll adjusting the speed of web-forwarding rolls in response to fluctuations in the web tension.

The speed at which webs may be coated according to the invention depends on several factors including the material of the web and the thickness of the applied coatings. However, we have observed that polymeric films are suitably coated at relatively high linear speeds — for example of the order of 1,200 to 2,000 feet per minute (6 to 10 meters/second).

The technique of the present invention is particularly suitable for applying a primer or anchor coating to a film, particularly a thermoplastic polymeric film, a typical primer comprising an interpolymerised condensation resin prepared as described in British Patent No. 1,134,876, by condensing a monoaldehyde with an interpolymer of acrylamide or methacrylamide with at least one other unsaturated monomer, or, as described in British Patent No. 1,174,328, by condensing a monoaldehyde with acrylamide or methacrylamide, and subsequently interpolymerising the condensation product with at least one other unsaturated monomer, the condensation reaction being effected in both cases in the presence of an alkanol containing from one to six carbon atoms.

Preferred interpolymerised condensation resins for use as primers on thermoplastic polymeric films comprise a copolymer derived from up to 90% by weight of styrene, up to 80% by weight of an alkyl acrylate, up to 15% by weight of methacrylic acid, and from 5% to 25% by weight of acrylamide which has been condensed with a solution of formaldehyde in n-butanol containing from 0.2 to 3 equivalents of formaldehyde for each amide group in the copolymer. A particularly useful resin is a 50% solids solution of a copolymer resin containing 38.5 parts of styrene, 44 parts of ethyl acrylate, 2.5 parts of methacrylic acid, and 15 parts of acrylamide which has been condensed with 5.2 parts of formaldehyde in n-butanol. This resin is then diluted to a solution of an appropriate solids content, for example 5 to 20% solids, with, for example, industrial methylated spirits, or a 50:50 mixture thereof with xylene (the parts referred to here and throughout the specification are the proportions of the constituents by weight). Another useful composition is one in which the ethyl acrylate has been replaced by 2-ethyl hexyl acrylate.

A catalyst should preferably be added to the composition to promote the cross-linking of the resin to improve the adhesion between the applied coating and the base film.

The resin may be applied to each gravure roll, and thence to the film, as a dispersion or as a solution. Economically it would be preferable to apply the resin as a dispersion in water. Aqueous dispersion techniques have the added advantage that there is no residual odour due to the solvent present which is generally the case when an organic solvent is used. However, when using aqueous techniques it is usually necessary to heat the film to a higher temperature to dry off the dispersant than with systems using an organic solvent or dispersant. Furthermore, the presence of a surfactant, which is generally used to improve the dispersion of the coating in water, tends to reduce the adhesion between the resin and the base film. Thus, it is preferred to apply the resin from an organic solvent or dispersant. Examples of suitable organic solvents include alcohols, aromatic hydrocarbon solvents, such as xylene, or mixtures of such solvents as is appropriate.

The thickness of the coating applied to each surface of the film, or other web, can be adjusted by, inter alia, appropriate selection of the depth and pattern of the cells on the surface of each gravure roll, and by the setting of the doctor blade, or similar metering device. An interpolymerised condensation resin, of the kind hereinbefore described, is suitably deposited on a polymeric film to form a coating having a wet thickness of the order of 10 gauge (2.5 $\mu$m), but the wet thickness of the coating may be varied over a wide range depending on the solids content of the coating medium and the desired thickness of the subsequently dried coating. The thickness of the coatings on opposed surfaces of the film may, but need not, be identical.

Other coatings, including heat-sealable coatings, may be applied to films or webs by the procedures of the present invention, and the same, or different, coatings may be deposited on opposed surfaces of the film or web. In particular, a heat-sealable coating may be applied to a polymeric film already primed with an interpolymerised condensation resin of the kind hereinbefore described.

We prefer to employ copolymers of vinylidene chloride with acrylonitrile as heat-sealable coatings because they give hard coatings and good heat-seal strengths, and are also resistant to moisture and have low gas permeability. It is particularly preferred to use copolymers containing between 80% and 95% by weight of vinylidene chloride and up to 20% by weight acrylonitrile. These copolymers may contain other monomers such as acrylic acid, itaconic acid and methacrylic acid, but a particularly preferred heat-sealable resin comprises a copolymer containing 88 weight % of vinylidene chloride and 12 weight % of acrylonitrile. The heat-seal coating may be applied to the film as a solution or a dispersion, but the solvent or dispersant should not be such that it will dissolve any resin coating already on the film. For economic reasons application as an aqueous dispersion is preferred.

Coatings applied in accordance with the present invention may be dried by conventional methods, for example — by passing the coated web through an air oven maintained at an appropriate temperature. A float oven in which the coated web floats on a current of heated air is particularly suitable.

Coatings applied in accordance with the present invention may contain agents to control or improve the characteristics of the coated web. Thus, agents such as dyes, pigments, lubricants, anti-static agents, anti-oxidants, anti-blocking agents, surface-active agents, slip aids, stiffening aids, gloss-improvers, prodegradants, and ultra-violet light stabilizers may be employed.

Webs such as paper, paperboard, cellulosic films, metal foils, polymeric films, and laminates thereof, are suitably coated or printed by the techniques of the present invention. Typical polymeric films include films formed from polycarbonates, polysulphones, polyurethanes, polyamides such as polyhexamethylene adipamide or polycaprolactam, polyesters such as polyethylene terephthalate and polyethylene-1, 2-diphenoxyethane-4, 4#-dicarboxylate, vinyl polymers and copolymers, and polymers and copolymers of 1-olefins such as ethylene, propylene, butene-1, and 4-methylpentene-1. A particularly useful thermoplastic polymeric film is that formed from a high molecular weight stereoregular predominantly crystalline polymer of propylene, either in the form of a homopolymer or copolymerised with minor quantities (e.g. up to 15% by weight of the copolymer) of at least one other unsaturated monomer, such as ethylene.

Films are suitably formed from these materials in any conventional manner, as, for example, by rolling, extruding, pressing, and solvent-casting or melt casting techniques.

The films may be unoriented, but are preferably oriented in one or both directions in the plane of the film to impart strength thereto. If oriented in both directions, the orientation may be equal in those directions or unequal, for example with the higher degree of orientation in a preferred direction (usually the longitudinal direction, i.e. the direction in which the polymeric material is extruded and processed during the film-forming process).

Preferably, the oriented film is "heat-set", i.e. dimensional stability of the film is improved by heating the film, while restrained against thermal shrinkage, to a temperature above the glass transition temperature of the polymer from which the film is formed but below the melting point thereof.

Suitably, a film is produced by melt extruding a polymer, such as polypropylene, in the form of a tube from an annular die, cooling the extruded tube, reheating and inflating the tube by the so-called "bubble" process to introduce transverse orientation, and simultaneously elongating the tube longitudinally to orient the film in a lengthwise direction. The film is then preferably slit, "heat-set", discharge-treated, and coated or printed as hereindescribed.

Films treated according to the present invention may vary in thickness depending on the intended application, but usually we find that films having a thickness of from 2 to 150 microns are of general utility. Films intended for use in packaging operations are suitably within a thickness range of from 10 to 50 microns.

The coating system of the present invention offers numerous advantages over prior art systems. In particular, the facility of simultaneously applying a gravure coating to both surfaces of a moving web constitutes a significant technical advance. A single oven may be employed to dry the applied coatings, and the complicated web-handling equipment normally required in sequential coating operations, to reroute the web for a second pass through the oven, may be eliminated. Disruption of one coating during application of a subsequent coating is thereby avoided. The coating assembly itself is extremely compact, and by elimination of conventional backing rolls reduces to three (two gravure, one transfer) the number of rolls constituting the coating assembly. Space requirements for installation of the equipment are therefore reduced to a minimum. In addition, the preferred mounting assembly for the transfer roll enables the latter to be continuously bathed with coating liquid in the disengaged position so that coating material does not dry out and accumulate on the surface of the transfer roll. Should this happen, acceptable web coating cannot normally be achieved until the transfer roll surface has been thoroughly cleaned. The disengaged transfer roll, by virtue of its slidable mounting assembly, is readily accessible for cleaning and maintenance when required.

Figure 2:
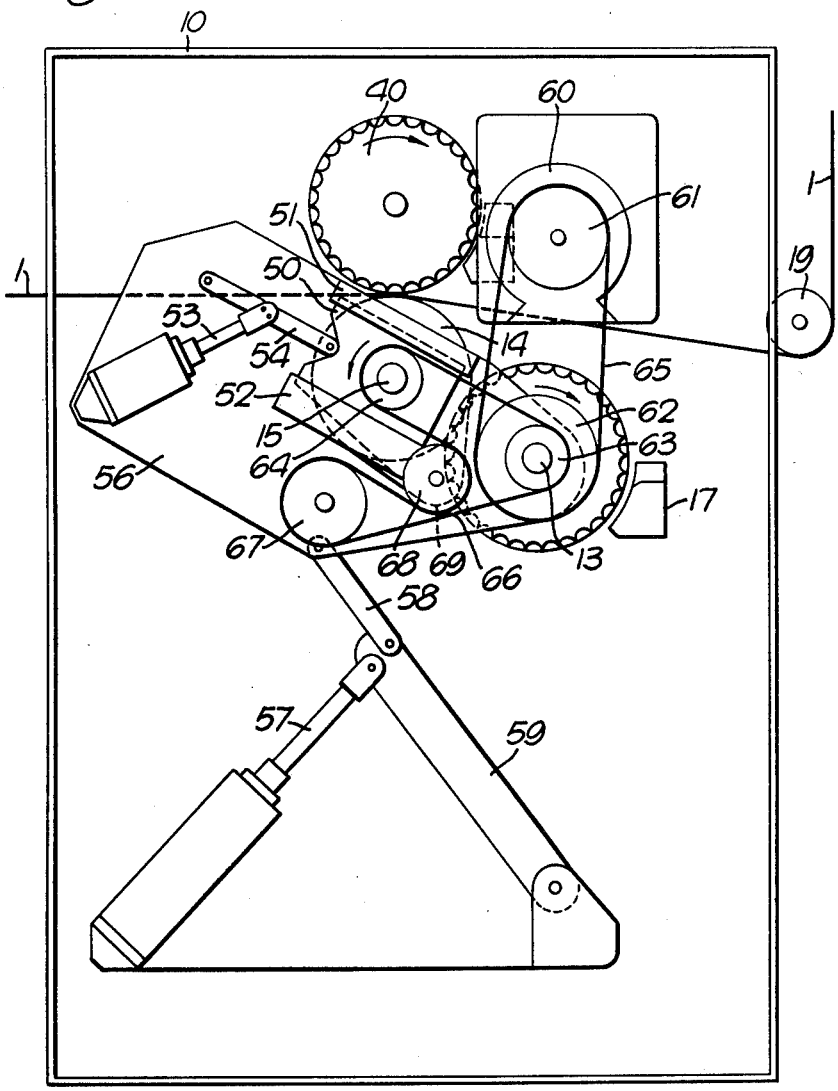
Figure 3:
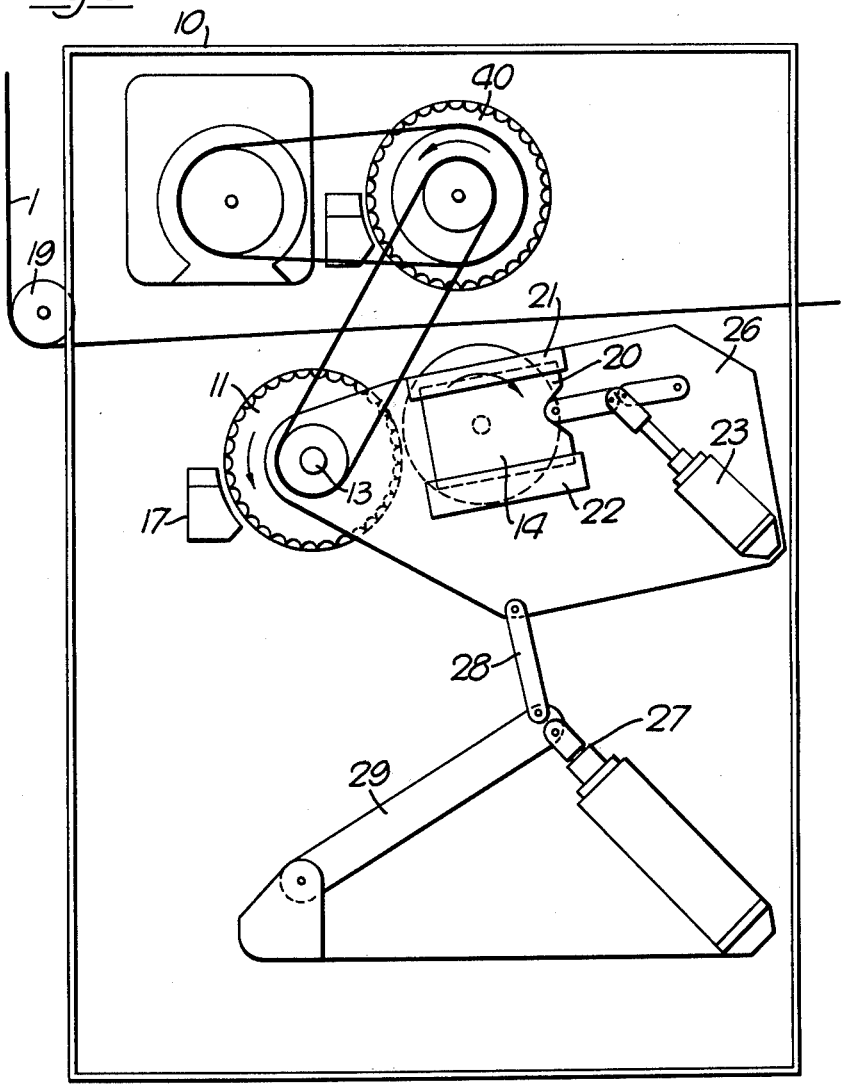
Figure 4:
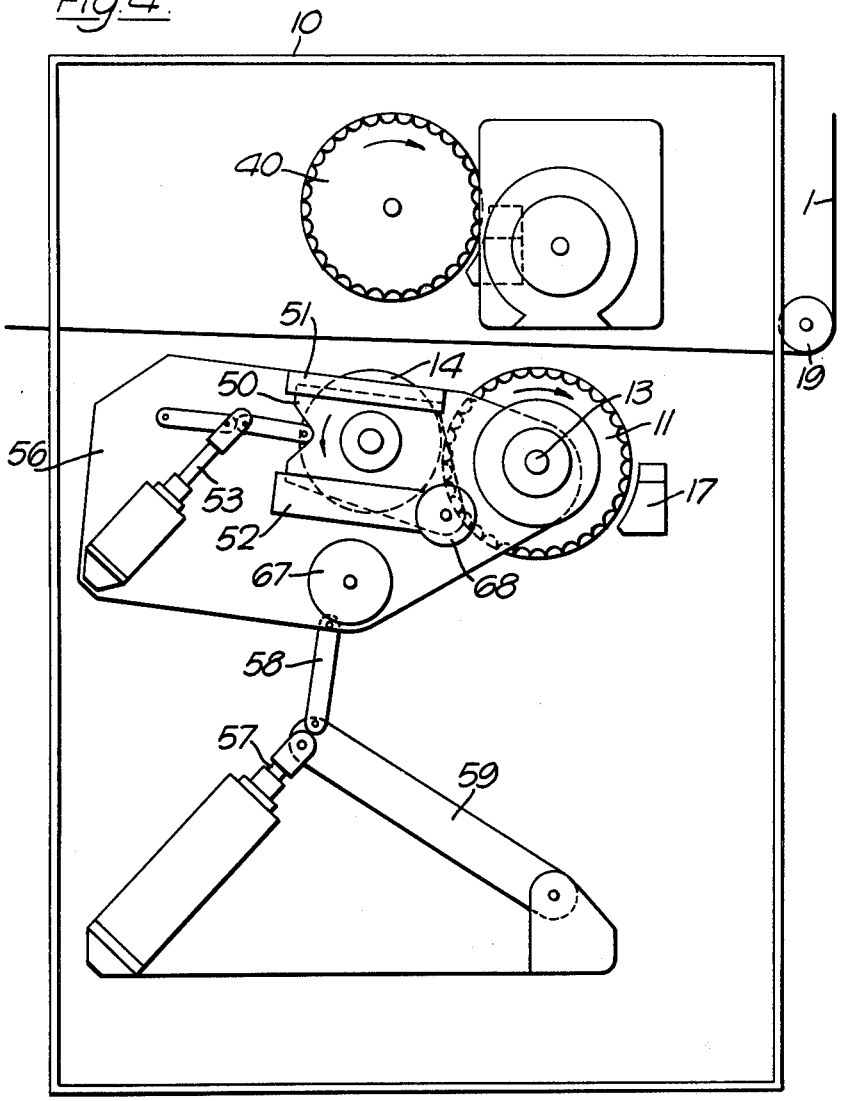

The invention is illustrated by reference to the accompanying drawings in which:

FIG. 1 is a schematic side elevation of a direct-indirect gravure system in an operative position for simultaneously coating both surfaces of a moving web, FIG. 2 is a schematic side elevation of the system of FIG. 1 viewed from the opposite end of the gravure roll axis, FIG. 3 is a schematic side elevation of the system of FIG. 1 with the transfer roll in an inoperative position, and FIG. 4 is a schematic side elevation of the system of FIG. 3 viewed from the opposite end of the roll axis and omitting the belt drive system for the sake of clarity.

Referring to the drawings, particularly to FIG. 1 thereof, the coating apparatus is generally located within and supported by a substantially rigid framework 10. A gravure roll 11 having on the surface thereof a pattern of cells or depressions 12 is mounted on shaft 13 for rotational engagement with the resilient surface of transfer roll 14 rotatably mounted on shaft 15.

A pool of coating liquid 16 is maintained in a profiled trough 17 positioned parallel to the axis of rotation of gravure roll 11, and extending across the width thereof, so that the surface of the gravure roll contacts the pool of coating liquid and effectively constitutes one wall of the trough. Coating liquid picked up by the cells 12 as the gravure roll rotates is metered by a flexible doctor blade 18 located at the bottom of the trough, and inclined at an appropriate angle to the gravure surface. Provision may be made to recycle excess coating liquid, removed by doctor blade 18, to trough 17.

The metered supply of coating liquid is transferred from the cell 12 to the resilient surface of independently driven cooperating transfer roll 14, and thence to the lower surface of a moving web 1, fed from a source of supply (not shown) around an idler roll 19, and into contact with the transfer roll surface before passing to a further treatment station — such as a float drying oven (not shown). The surface of transfer roll 14, thus, simultaneously engages the lower surface of web 1 and the cellular surface 12 of gravure roll 11.

The end of shaft 15 supporting transfer roll 14 is located in a slidable assembly comprising a plate 20 slidably mounted in guides 21, 22 for radial displacement of transfer roll 14 relative to gravure support shaft 13 by actuation of a pneumatic or hydraulic piston assembly 23, operating through pivotally mounted couplings 24, 25. This entire slidable supporting assembly is mounted on a supporting member or plate 26 mounted for pivotal movement in a substantially vertical plane about shaft 13 by actuation of a pneumatic or hydraulic piston assembly 27 in conjunction with pivotally mounted couplings 28, 29.

Gravure roll 11 can be driven, in the direction of the arrow, by electric motor 30 operating through a system of pulleys 31, 32, 33, 34 and endless belts 35, 36. Preferably, the pulleys and belts are toothed to ensure positive control of the rotational speed of gravure roll 11.

A second gravure roll 40 mounted on a shaft 41 cooperates with transfer roll 14 to provide a nip through which web 1 is fed during the coating operation. Shaft 41 is suitably coupled to pulley 32 — thereby being driven, by electric motor 30, and driving gravure roll 40 in the same sense, i.e. in the direction of movement of the web, and at the same peripheral speed as gravure roll 11. Coating liquid 42 contained in a profiled trough 43, similar to trough 17 is metered by a flexible doctor blade 44 on to the cellular surface 45 of gravure roll 40 from which it is transferred directly to the upper surface of web 1 in the nip between gravure roll 40 and transfer roll 14.

FIG. 2 illustrates the coating system viewed from the opposite end of the gravure roll assembly depicted in FIG. 1, and, in particular, the transmission system for driving transfer roll 14 in contact with the lower surface of web 1. Thus, the end of shaft 15 supporting transfer roll 14 is located in a slidable assembly, similar to that of FIG. 1 and comprising a plate 50 slidably mounted in guides 51, 52 for radial displacement of the transfer roll relative to gravure support shaft 13 by actuating means such as a pneumatic or hydraulic piston assembly 53 operating through pivotally mounted couplings 54, 55. This slidable assembly is mounted on a supporting member or plate 56, similar to plate 26 of FIG. 1, and mounted for pivotal movement in a substantially vertical plane about shaft 13 by actuation of a pneumatic or hydraulic piston assembly 57 in conjunction with pivotally mounted couplings 58, 59.

Transfer roll 14 can be rotated, in the direction of the arrow, by electric motor 60 operating, independently of motor 30, through a system of pulleys and belts, preferably toothed. Thus, motor pulley 61 transmits motion to compound pulley 62, 63, freely rotatable on shaft 13, and thence to pulley 64, fixedly secured to shaft 15, via endless belts 65, 66. The pulley system cooperating with belt 66 comprises four pulleys, viz 63 and 64, already referred to, and two additional pulleys 67, 68, pulley 67 being freely rotatable on supporting plate 56, and pulley 68 being freely rotatable on slidable plate 50, thereby ensuring that when transfer roll 14 is disengaged from the surface of gravure roll 11, by slidable displacement of plates 50 and 20 (FIG. 1), the path length of belt 66 remains constant so that the transfer roll can continue to be driven by electric motor 60. It will be noted that slidable plate 50, differs from the substantially rectangular configuration of corresponding plate 20 (FIG. 1) by the provision of a tail portion 69 on which pulley 68 is mounted.

To displace transfer roll 14 from the operative position illustrated in FIGS. 1 and 2, simultaneous actuation of piston assemblies 27 and 57 pivotally displaces supporting plates 26 and 56 about the axis of shaft 13, thereby disengaging transfer roll 14 from the lower web surface to an inoperative position, as illustrated in FIGS. 3 and 4. Throughout the movement to the inoperative position transfer roll 14 remains in contact with the surface of gravure roll 11, thereby ensuring that the surface of the transfer roll is constantly wetted by coating solution supplied from trough 17. It will be noted that idler guide roll 19 around which the web is fed to the nip between transfer roll 14 and gravure roll 40 is off-set relative to the nip so that on movement of the transfer roll to the inoperative position the web adopts a path which is clear of the transfer and both gravure rolls, e.g. guide roll 19 is located below a plane extending through the coating nip and normal to the plane embracing the axes of rotation of rolls 14 and 40.

If desired, the transfer roll, while in the inoperative position of FIGS. 3 and 4, can be displaced, for inspection or treatment of the roll surface, by simultaneous actuation of piston assemblies 23 and 53, thereby causing plates 20 and 50 to slide in respective sets of guides 21, 22 and 51, 52. When so slidably displaced, transfer roll 14 can, if desired, continue to be driven by virtue of slidably mounted pulley 68 which maintains the required tension in drive belt 66.

The invention is further illustrated by reference to the following Example.

EXAMPLE

A polypropylene film, 24 microns thick and 28 inches (711 mm) wide, was coated on an assembly of the kind described with reference to the drawings, the transfer and gravure rolls each being about 34 inches (864 mm) wide, and the transfer roll having a diameter of 12 inches (305 mm) while that of each of the gravure rolls was about 16 inches (406 mm). The surface of each gravure roll comprised approximately hemispherical cells having an average depth of 35.5 microns and an average diameter at the roll surface of 96.5 microns, the cells being present on each gravure roll surface at a density of about 12,100 per in$^2$ (1880 per cm$^2$).

A coating liquid comprising an acrylic interpolymerised condensation resin, as hereinbefore described, diluted to a 12 wt % solids content with industrial methylated spirits, was supplied to the trough associated with each gravure roll, and thence to the polypropylene film which was fed through the coating nip at a linear speed of 1,500 feet per minute (7.6 meters per second), a linear tension of about 0.5 lb per inch width (0.09 kg per cm width) being maintained in the web on each side of the coating nip by means of appropriately positioned dancer roll assemblies. The coated film was immediately passed through an air float drying oven maintained at a temperature which progressively increased throughout the length of the oven from 65 to 85° C. The thickness of the dried coating was 0.5 gauge (0.127 μm) on the surface of the film coated by the direct gravure roll, and 0.45 gauge (0.114 μm) on the surface coated by the indirect gravure roll.

Examination of the coated film showed that the coating on each surface was of substantially uniform thickness, and was firmly bonded to the substrate film. When necessary, the coating operation was halted by pivotal displacement of the transfer roll to an inoperative position in which its surface was continuously wetted by coating liquid supplied from the first gravure roll. On resumption of the coating operation, coated film of comparable quality and uniformity was readily produced.

I claim:

1. Apparatus for simultaneously applying a coating to each surface of a moving continuous web comprising a first, fixedly positioned, rotatably driven gravure roll, a transfer roll rotatable in an operative position in simultaneous contact with the surface of the first gravure roll and with a first surface of the moving web, a second gravure roll rotatable in contact with a second surface of the moving web and cooperating with the transfer roll to provide a nip through which the web may be passed, means for supplying a coating medium to the surface of the second gravure roll, mounting means for the transfer roll, said mounting means being operable to displace the transfer roll, relative to the fixedly positioned gravure roll, to an inoperative position in which the transfer roll is disengaged from the web surface but is rotatable in contact with the surface of the first gravure roll, means for disengaging the transfer roll from the surface of the first gravure roll, means for supplying a coating medium to the surface of the first gravure roll when the transfer roll is in both its operative and inoperative positions whereby when the transfer roll is in its inoperative position it continues to receive coating material from the first gravure roll so that a crust of dry coating material does no accumulate on the transfer roll, and means to cause the web to adopt a path which is clear of the transfer roll and both gravure rolls when the transfer roll is in the inoperative position.

2. Apparatus according to claim 1 wherein the mounting means is operable to maintain the transfer roll in rotatable contact with the first gravure roll throughout the transition from the operative to the inoperative position.

3. Apparatus according to claim 1 wherein the mounting means comprises a pair of axially spaced-apart support members mounted for pivotal displacement about the axis of rotation of the first gravure roll.

4. Apparatus according to claim 1 wherein the disengaging means comprises a pair of slide mountings for the transfer roll, each of the slide mountings being slidably associated with the respective pivotal support member for radial displacement of the transfer roll relative to the rotational axis of the first gravure roll.

5. Apparatus according to claim 1 wherein said means to cause the web to adopt a path which is clear of the transfer roll and both gravure rolls comprises a web guide member off-set relative to the coating nip.

6. Apparatus according to claim 1 wherein the surface of at least one of the gravure rolls comprises substantially hemispherical cells at a density of from 10,000 to 40,000 cells per square inch.

* * * * *